United States Patent [19]

Buratovich

[11] 3,949,802

[45] Apr. 13, 1976

[54] TENSIONING DEVICES

[76] Inventor: Prosper Buratovich, 460 Shannon Place, Cliffside Park, N.J. 07010

[22] Filed: Jan. 3, 1975

[21] Appl. No.: 538,354

[52] U.S. Cl. ..... 160/374.1; 312/140
[51] Int. Cl.[2] ..... A47G 5/00; E06B 9/24
[58] Field of Search ..... 160/374.1, 374, 381; 292/251; 312/262, 263, 265, 140; 38/102.1

[56] References Cited

UNITED STATES PATENTS

| | | | |
|---|---|---|---|
| 910,817 | 1/1909 | Himmel | 312/140 |
| 1,173,872 | 2/1916 | Ruse | 312/140 |
| 1,562,153 | 11/1925 | Elbern | 160/374.1 |
| 1,765,388 | 6/1930 | Watson | 160/381 |
| 1,847,925 | 3/1932 | Carter | 160/374.1 |
| 1,870,492 | 8/1932 | Clark | 160/374.1 |
| 1,876,486 | 9/1932 | Britten | 160/374 |
| 1,916,023 | 6/1933 | Shull | 160/374.1 |
| 2,219,338 | 10/1940 | Segal | 292/251 |
| 2,491,600 | 12/1949 | Bearce | 160/374.1 |
| 2,889,018 | 6/1959 | Swan | 292/256.67 |
| 3,625,274 | 12/1971 | Johnson | 160/374.1 |

*Primary Examiner*—Paul R. Gilliam
*Assistant Examiner*—Victor N. Sakran

[57] ABSTRACT

A tensioning device for enabling application of a variable tension that may be securely maintained against an artist's canvas mounted on stretcher bars. The tensioning assembly includes a bracket member provided with a pair of ears or the like for threadably mounting an adjusting screw which may be locked upon appropriate adjustment. Preferably, a pair of tensioning devices are provided at intersecting corners of conventional mitered tongue and groove stretcher bars such that each device rigidly affixed to a corresponding bar is disposed to apply an adjustable and readily maintainable tension to the adjacent bar upon appropriate adjustment of respective adjusting screws. In this manner, a canvas or other flexible member affixed to the stretcher bars may be stretched to a desired extent by application of a carefully controlled tensioning force applied by adjusting screws.

1 Claim, 4 Drawing Figures

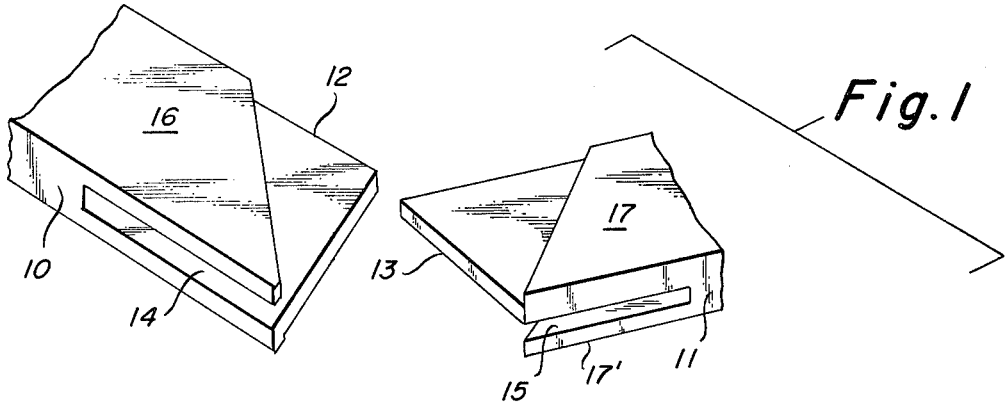
Fig. 1
Fig. 2
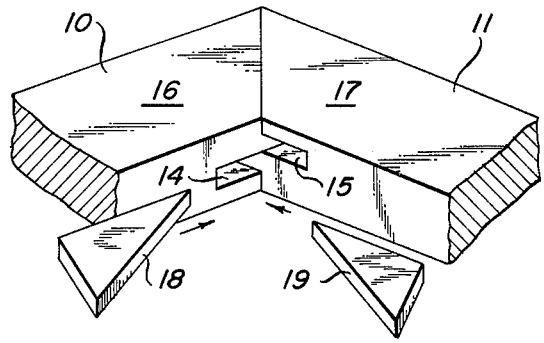
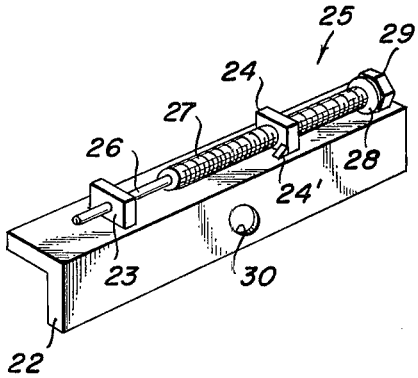
Fig. 3
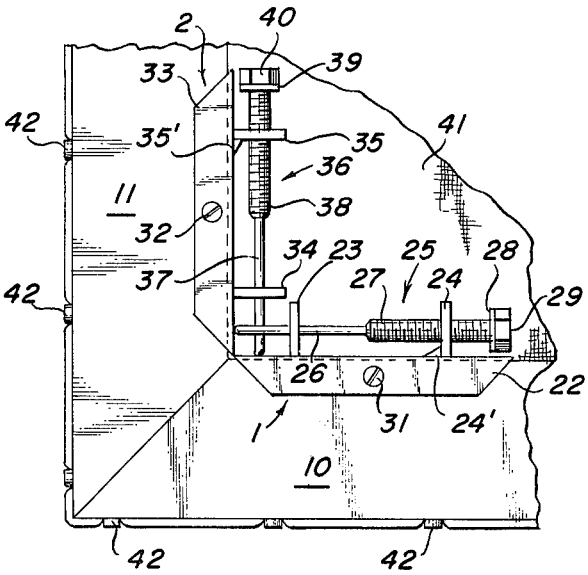
Fig. 4

TENSIONING DEVICES

BACKGROUND OF THE INVENTION

This invention relates to tensioning devices and more particularly to devices for applying a carefully controlled tension to members such as stretcher bars upon which an artist's canvas is mounted.

In mounting a canvas on a supporting frame, it is common practice to form a frame from four stretcher bars, each of which is provided with mitered tongue and groove corners which mate with corresponding corners of adjacent bars. Generally, upon affixing the canvas to such stretcher bars, such as by stapling or tacking the canvas edges to the bars, the canvas is rendered taut by the application of an outwardly directed tension force against the stretcher bar frame. Commonly, such tension is applied by driving wooden wedges, for example by a hammer or the like, into the open corner portion of mated bars. This technique for tensioning stretcher bars has the disadvantage of providing no means for retaining wedges in place and, over a period of time shrinkage of both wedges and stretcher bars will result in wedges falling from a frame with a concommitant loss of canvas tension. A further disadvantage of wedge tensioning techniques has become apparent during the cleaning and reframing of older canvases. It has been found that when tension is applied to a reframed, older canvas, a great deal of care must be exercised in the process so as not to apply excessive amounts of tension which can easily result in the production of cracks or other faults in valuable canvases. However, in utilizing a wedge tensioning technique as aforesaid, it is extremely difficult to control the intensity of force applied to a wedge by a hammer or the like. Accordingly, by striking a wedge with too great an impact, cracks are easily produced in older canvases during reframing. Thus, a clear need exists for devices capable of applying a carefully controlled tension force to stretcher bars and assuring that such tension is securely maintained.

In order to avoid the foregoing adverse effects encountered upon employing wedge techniques for tensioning stretcher bars, it has been proposed to utilize set screws operating against stretcher bars as illustrated in U.S. Pat. No. 1,562,153. The device described therein includes a single corner bracket affixed to both stretcher bars by means of nails or the like with set screws threadably engaged with each bracket arm and effective to apply a tension force in a direction parallel to the longitudinal axis of such nails. Adjustment of set screws however, can result in the separation of bracket arms from the stretcher bar to which such bracket is attached. In U.S. Pat. No. 2,491,600, a tensioning device for stretcher bars includes a wedge member formed integrally with an angle portion and upon adjustment of set screws, a force is applied against the stretcher bars. This device however, suffers from the disadvantage of other wedge type tensioning devices, namely upon aging, the wedge may slip within slots formed in the stretcher bars with a corresponding loss of canvas tension.

OBJECTS OF THE INVENTION

Accordingly, it is an object of the present invention to provide a tensioning device for enabling the application of a carefully controlled, infinitely variable tension to a canvas mounted on stretcher bars.

It is another object of the present invention to provide a tensioning device for use with stretcher bars wherein maintainence of a desired set tension for substantial periods of time is assured.

Other objects of the present invention will become apparent from the detailed description of any exemplary embodiment thereof which follows and the novel features will be pointed out in conjunction with the claims appended hereto.

SUMMARY

In accordance with the present invention, a device for applying a tension to members such as stretcher bars includes a bracket member which may be mounted on a first stretcher bar, an adjusting screw having a tip for engaging a second stretcher bar and means for retaining the adjusting screw such that upon adjustment thereof, the tip engages and applies an infinitely adjustable tension force against the second stretcher bar. The bracket member is preferably retained regidly against the first stretcher bar by a nail or screw and a second bracket, adjusting screw and retaining means are provided to similarly apply a controlled tension force against the first stretcher bar. The adjusting screw may be mounted on the tensioning device by means of ears extending from one bracket surface. One of such ears may be adapted to threadably receive the adjusting screw and the other ear may be configured to slidably receive the tip portion of the adjusting screw. In addition, suitable locking means, such as a conventional lock nut, may be provided to firmly secure and fix the position of the adjusting screw upon application of a desired tension force against the stretcher bars.

BRIEF DESCRIPTION OF THE DRAWING

The invention will be more clearly understood by reference to the following detailed description of an exemplary embodiment thereof in conjunction with the following drawing in which:

FIGS. 1 and 2 are partial isometric views of corner portions of conventional stretcher bars;

FIG. 3 is an isometric view of a tensioning device for stretcher bars in accordance with the present invention; and FIG. 4 is a partial elevational view of a pair of stretcher bars subjected to a tension force by a pair of tensioning devices in accordance with the present invention.

DESCRIPTION OF THE PREFERRED EMBODIMENT

Referring now to FIG. 1, illustrated therein are the corners of a pair of mating, conventional stretcher bars 10 and 11 each of which is provided with tongue portions 12 and 13, respectively. In addition, grooves 14 and 15 are formed in bars 10 and 11 and are adapted to slidably receive tongue portions 12 and 13, respectively. Upper mitered sections 16 and 17 are formed in bars 10 and 11 and for purposes of illustration, a lower mitered section is depicted. Upon sliding the corners of stretcher bars 10 and 11 into engagement, vertical faces of mitered sections 16 and 17 will be brought into contact while a portion of each groove 14 and 15 will be exposed as illustrated in FIG. 2. Commonly, members such as wedges 18 and 19 are driven into grooves 14 and 15, respectively, by blows of a hammer or the like to stretch a canvas affixed to bars 10 and 11. As previously noted, wedges 18 and 19 are prone to falling from grooves 14 and 15 thereby resulting in a loss of canvas tension.

Referring now to FIG. 3, there is illustrated an exemplary embodiment of a device 1 for expanding or tensioning stretcher bars (as, for example, depicted in FIG. 2) and which is generally comprised of bracket 22, retaining ears 23 and 24 and adjusting screw 25. Bracket 22 is preferably a right angle bracket provided with an aperture 30 for enabling bracket 22 to be firmly affixed to a stretcher bar (not shown) by means of a nail or screw. Mounting ears 23 and 24 extend substantially normally from the surface of bracket 22 adjacent the surface provided with aperture 30. Ears 23 and 24 may be separately affixed to bracket 22, or preferably, such ears are merely punched out of one portion of the braclet by any well known punching or stamping technique. Adjusting screw 25 is comprised of a tip portion 26 for engaging the side of a stretcher bar as will be described hereinafter and is integrally formed with a threaded portion 27 and head 29. Preferably a locking nut 28, well known to those skilled in the art, is provided to enable head 29 to be maintained in a secured position upon adjustment of nut 28. Ears 23 and 24 are adapted to threadedly receive portion 27 of screw 25 and slidably receive tip portion 26, respectively such that screw 25 is mounted spaced from and parallel to one surface of bracket 22. Alternately, retaining ear 23 may be adapted to receive threaded portion 27 should it be desired to utilize a screw 25 with a longer threaded portion than is illustrated in FIG. 3. Finally, a metal or plastic fillet 24' is affixed to bracket 22 and retaining ear 24 to support ear 24 upon the application of pressure engendered by turning adjusting screw 25.

The operation of the aforedescribed tensioning device 1 according to the present invention will be described in conjunction with a further similar device 2, both of which are mounted at the corner portions of of stretcher bars 10 and 11 as illustrated in FIG. 4. Accordingly, tensioning device 1 previously described in connection with FIG. 3 is affixed to stretcher bar 10 by means of screw 31 and a similar tensioning device 2 is affixed to stretcher bar 11. Device 2 is substantially similar to tensioning device 1 and is comprised of bracket 33, retaining ears 34 and 35, and adjusting screw 36. In addition, a fillet portion 35' is provided with ear 35. Screw 36 includes a tip portion 37, threaded portion 38, head 40 and a locking nut 39. It will be appreciated however that adjusting screw 36 is mounted on bracket 33 in a direction opposite to the mounting of screw 25 on a corresponding surface of bracket 22. Accordingly, devices 1 and 2 may be considered as 'right-hand' of 'left-hand' tensioning devices and a complementary pair of such devices will be required at each corner of slidably engaged stretcher bars. Furthermore, each of adjusting screws 25 and 36 are mounted with respect to brackets 22 and 33, respectively, such that corresponding tip portions 26 and 37 are displaced slightly from one another.

In order to stretch a canvas 41 previously affixed to the edges of stretcher bars 10, 11, etc. by, for example, means of nails 42 or the like, tensioning devices 1 and 2 are affixed to associated stretcher bars 10 and 11 by means of screws 31 and 32, respectively. Adjusting screws 25 and 36 are tightened to cause tip portions 26 and 37 to engage stretcher bars 11 and 10, respectively, thereby forcing such bars outwardly and applying a tension to, or stretching, canvas 41. The adjusted positions of screws 25 and 36 are secured by locknuts 28 and 39, respectively. In this manner, a desired tension is applied to canvas 41 and is securely maintained.

It will be appreciated that pairs of devices similar to tensioning devices 1 and 2 will be supplied and operated at each of the four corners of a conventional, rectangular array of stretcher bars to enable of a tension substantially throughout a canvas 41. Furthermore, tensioning devices 1 and 2 according to the present invention do not require specially designed stretcher bars but are adapted for use with conventional, inexpensive and readily available stretcher bars.

While the present invention has been particularly described in terms of specific embodiments thereof, it will be understood that numerous variations upon the invention are now enabled to those skilled in the art, which variations are yet within the scope of the instant teaching. Accordingly, the instant invention is to be broadly construed and limited only by the scope of the claims appended hereto.

What is claimed is:

1. A device for applying tension to an artist's canvas affixed to mitered corner, tongue and groove stretcher bars comprising a substantially right angle bracket member adapted to engage first and second sides of one of said stretcher bars with one surface of said bracket member provided with an aperture therethrough; means cooperating with said aperture for affixing said bracket member to said one of said stretcher bars; an adjusting screw having a threaded portion and a tip portion extending from said threaded portion; first and second mounting ears extending substantially perpendicularly from the other surface of said bracket member, said first ear having an aperture therethrough for receiving said tip portion and said second ear having an aperture therethrough for receiving said threaded portion, said adjusting screw being mounted in a substantially parallel relationship to said other surface of said bracket member; and a fillet affixed to said second ear and to said other surface of said bracket member such that upon adjustment of said screw, said fillet is effective to maintain said second ear substantially perpendicular to said other surface and said tip portion engages another one of said stretcher bars whereby a controlled tension is applied to said artist's canvas.

* * * * *